US005839206A

United States Patent [19]

Lisson et al.

[11] Patent Number: 5,839,206

[45] Date of Patent: Nov. 24, 1998

[54] DRYING STATION FOR LIQUID OR DAMP WASTE USING A PLIABLE HEATING MAT

[75] Inventors: Johann Lisson, Darmstadt; Karl-Heinz Kleinschroth, Moerfeldeh-Walldorf; Klaus Blinn, Rödermark, all of Germany

[73] Assignee: Siemens Aktiengesellschaft, Munich, Germany

[21] Appl. No.: 834,531

[22] Filed: Apr. 4, 1997

[30] Foreign Application Priority Data

Oct. 4, 1994 [DE] Germany ..... 44 35 236.0

[51] Int. Cl.[6] ..... D06F 58/00

[52] U.S. Cl. ..... 34/132

[58] Field of Search ..... 34/61, 62, 65, 34/66, 77, 78, 86, 130, 131, 132, 169, 175, 219; 110/229, 345; 159/47.3, DIG. 12; 588/16, 20

[56] References Cited

U.S. PATENT DOCUMENTS 4,040,973 8/1977 Szivos et al. .

5,430,227 7/1995 Erbse et al. ..... 588/20

FOREIGN PATENT DOCUMENTS 2660788 10/1991 France .
3432103A1 3/1986 Germany .
4023163A1 1/1992 Germany .

OTHER PUBLICATIONS

Japanese Patent Abstract No. 7043496 (Fumio et al.), dated Feb. 14, 1995.
Derwent Publication No. 95–385985, Oct. 1995.

*Primary Examiner*—Henry A. Bennett
*Assistant Examiner*—Steve Gravini
*Attorney, Agent, or Firm*—Herbert L. Lerner; Laurence A. Greenberg

[57] ABSTRACT

A drying station with low energy consumption and short drying time for drying liquid or damp waste, especially contaminated waste from a nuclear power station, includes at least one heating mat for delivering heat of evaporation into a container in order to fully and reliably ensure the drying of material in the container. A retainer automatically produces a large-area mechanical contact between the heating mat and the container when the container is brought into a drying position.

7 Claims, 1 Drawing Sheet

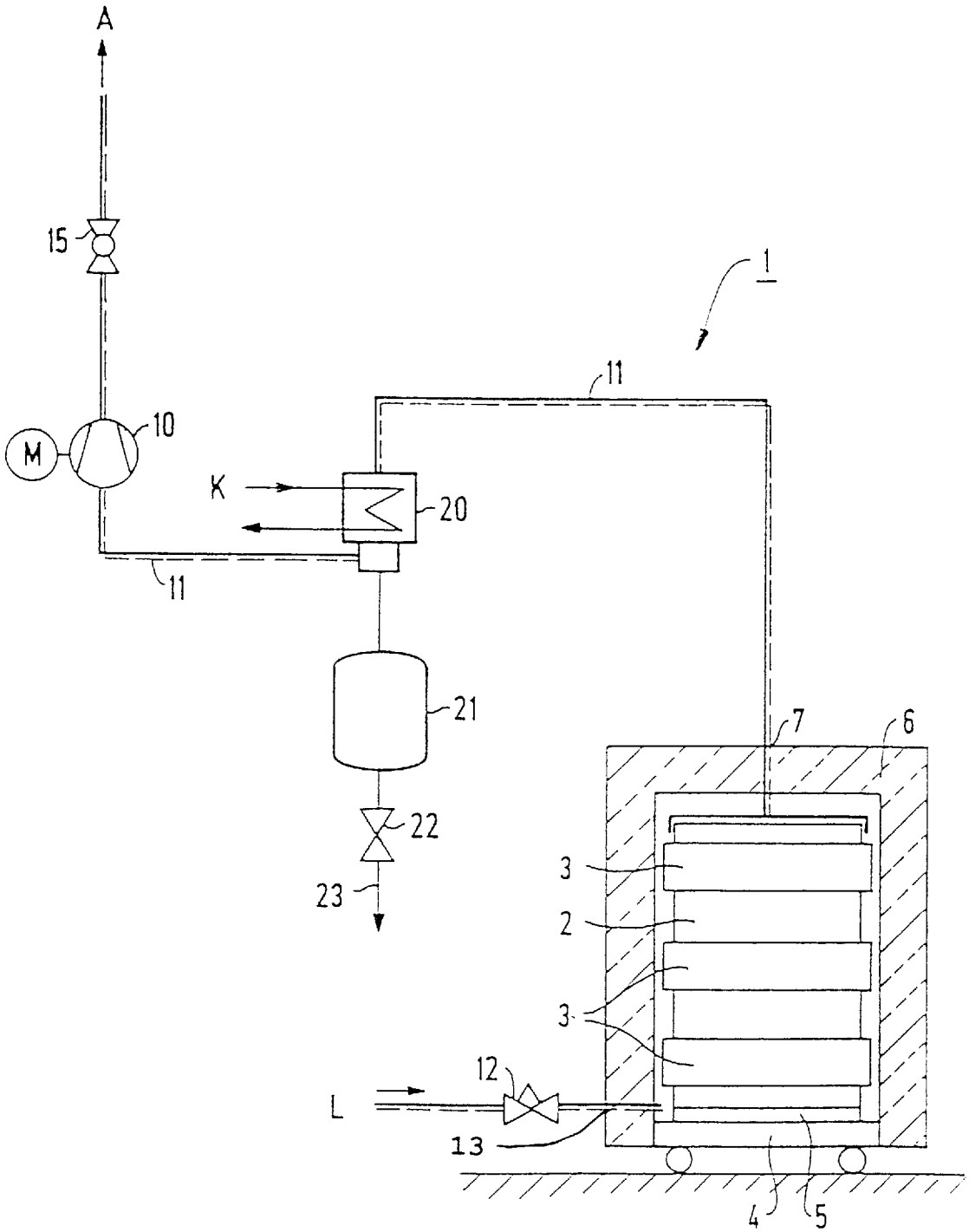
A
15
1
11
10
M
K
20
11
21
7
6
22
3
23
2
3
12
L
13
4
5

DRYING STATION FOR LIQUID OR DAMP WASTE USING A PLIABLE HEATING MAT

CROSS-REFERENCE TO RELATED APPLICATION

This application is a Continuation of International Application No. PCT/DE95/01301, filed Sep. 21, 1995.

BACKGROUND OF THE INVENTION

Field of the Invention

The invention relates to a drying station for drying material in a container, in particular contaminated waste from a nuclear power station.

Radioactively contaminated waste produced in a nuclear power station may contain moisture for various reasons, for example because of handling processes or after storage. A moisture content of, for example, more than 30% in the waste may lead to rotting and fermentation processes and to the formation of a gas, for example methane or hydrogen ($H_2$) . When the waste is stored, the gas (for example methane) that is consequently liberated may cause swelling and concomitant damage to the storage container, for example a 200 1 drum. In order to suppress the chemical/physical reactions caused by the moisture content in the waste, it is necessary to dry the waste thoroughly at an early stage.

Drying of nuclear power station waste which is in a container and which may be radioactively contaminated, is conventionally carried out in a drying station. In that station, the heat of evaporation required to dry the waste is delivered to the container, and therefore to the material which it contains, through the use of a heated gaseous medium, for example air. However, because of the poor thermal conductivity, for example of air, a drying process of that type is associated with large energy consumption. Furthermore, a long drying time is required so that the material throughput rate during drying is relatively low.

SUMMARY OF THE INVENTION

It is accordingly an object of the invention to provide a drying station for drying liquid or damp waste in a container, especially contaminated waste from a nuclear power station, which overcomes the hereinafore-mentioned disadvantages of the heretofore-known devices of this general type in such a way that reliable drying of material with a short drying time is possible with a low energy outlay and expenditure.

With the foregoing and other objects in view there is provided, in accordance with the invention, a drying station, comprising a container for receiving material to be dried, in particular contaminated waste from a nuclear power station; and at least one heating mat for delivering heat of evaporation into the container.

The invention is based on the consideration that, by using a heating mat, which can be produced cost-efficiently, and can be brought into direct contact with the container containing the material to be dried, the heat of evaporation required for the drying can be fed directly into the container. Since it is therefore not necessary to overcome the high thermal resistance of a poor conductor of heat, for example air, drying with low energy outlay is ensured and the required drying time is shortened. At least one electrically controllable heating mat then allows an individual drying program for each individual container which contains the material to be dried.

In accordance with another feature of the invention, in order to avoid the necessity of operating personnel coming into contact with the container containing the waste when dealing with radioactively contaminated waste from a nuclear power station, the drying station includes a retainer which automatically produces large-area mechanical contact between the heating mat and the container, when the container is brought into a drying position.

In accordance with a further feature of the invention, there is provided an insulating shell which surrounds the container together with the heating mat in the drying position and has a wall region as well as a cover region provided with a vent opening. As a result, the heat input into the container is increased with the same heating power for the heating mat. A directional airstream can be set up inside the insulating shell through the use of the vent opening in the cover region of the insulating shell, and through the use of an air circulation device connected to the vent opening, in particular using a fan. This stream allows controlled discharge of the moisture drawn from the contaminated waste by drying. In a further advantageous refinement, a collecting shell for collecting the moisture is disposed in front of the vent opening.

In accordance with an added feature of the invention, in order to provide end-point control of the drying process, that is to say to establish the time after which the residual moisture content of the material to be dried lies below a permissible limit value, a condensate-measuring device is disposed at a condenser connected to the vent opening. The condenser is used for condensing the moisture drawn from the waste during the drying process. The quantity of the moisture can be measured by the condensate-measuring device.

In accordance with an additional feature of the invention, in order to transport the container, for example to bring it into the drying position, a transport device is provided. In a particularly advantageous development, the transport device has a base heater and a base, with pallet-like construction, having insulation. The heat input into the container can be established particularly effectively by virtue of the base heater, and in conjunction with the heating mat. The transport device carrying the container may, for example, also be moved by using a fork-lift truck through the use of the pallet-like base of the transport device.

In accordance with a concomitant feature of the invention, the insulating shell has a ventilation opening formed therein for feeding in a ventilating medium to distribute the heat of evaporation.

The advantages achieved with the invention are, in particular, that by using the heating mat, heat of evaporation can be delivered into the material to be dried with low energy consumption and a short drying time.

Other features which are considered as characteristic for the invention are set forth in the appended claims.

Although the invention is illustrated and described herein as embodied in a drying station for liquid or damp waste, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The FIGURE of the drawing is a diagrammatic and schematic view of a drying station, especially a drum drying unit, for treating mixtures of waste by drying.

DESCRIPTION OF THE PREFERRED EMBODIMENTS

Referring now in detail to the single FIGURE of the drawing, there is seen a drying station 1 for drying material in a drum or container 2, especially contaminated waste from a nuclear power station, in which a plurality of electrically heated heating mats 3 are provided above one another for delivering heat of evaporation into the container 2. The heating mats 3 are applied or pressed flat onto a side wall of the container 2. A heating mat 3 may also be annular and matched to the contour of the container 2 in each case. At the start of a drying process, the container 2 is placed on a transport device 4, for example a frame or a container on rollers. The transport device 4 has a base heater 5 and a base, of pallet-like construction, with insulation. In the illustrative embodiment, the transport device 4 is, for example, a rail-borne wagon. The drying station 1 includes an insulating shell 6 which surrounds a drying space and has a vent opening 7 in a cover region thereof. In order to receive the container 2, the insulating shell 6 is equipped with two tiltable ¼ circle segment doors, to which the three heating mats 3 are secured, using a non-illustrated retainer. When the container 2 is brought into a drying position inside the insulating shell 6, the segment doors close automatically and the heating mats 3 are automatically brought into large-area mechanical contact with the container 2.

For this purpose, the heating mats 3 are mounted on both segment doors, for example by using non-illustrated spring elements, in such a way that they extend through an opening formed by the doors when the doors are opened. When the container 2 is brought against the opening formed by the doors, it comes into contact with the heating mats 3. When the container 2 is introduced further, the heating mats 3 thus bear automatically against the container 2 and finally close the doors using the spring elements.

After the container 2 has been brought into the drying space inside the insulating shell 6 by using the transport device 4, and after the large-area mechanical contact has been established between the heating mats 3 and the container 2, the container 2 is heated to a temperature necessary for drying the material which it contains, by using the heating mats 3 and the base heater 5. This temperature is selectable and adjustable for each individual container 2, according to the exact composition of the contents. An upward airstream is subsequently established inside the insulating shell 6 by using a motor-driven fan 10 which is connected through a line 11 to the vent opening 7, and through the use of a ventilation opening 13 for air L which can be throttled by a valve 12. An exhaust valve 15 at an end of the line 11 is used to discharge exhaust air A in a controlled fashion.

The thus achieved delivery of heat of evaporation through the wall of the container 2 into the material which it contains causes the moisture content of the material to be reduced. The moisture which is then produced in the form of vapor is fed through the line 11 to a condenser 20 interposed along the line 11. The moisture condenses there after heat exchange with a coolant K which is supplied. The quantity of condensed moisture is quantitatively determined in a condensate-measuring container 21 disposed at the condenser 20. An end point of the drying process can be established by using the quantity of condensed moisture which is determined. The condensed moisture can be fed, for example, to a drain, through the use of a discharge line 23 which can be closed off by using a valve 22.

It is possible to dry the material with low energy outlay and short drying time due to the large-area mechanical contact of the heating mats 3 with the container 2.

We claim:

1. A drying station, comprising:

a container for receiving material to be dried; and at least one heating mat for delivering heat of evaporation into said container.

2. The drying station according to claim 1, including a retainer for automatically producing large-area mechanical contact between said at least one heating mat and said container, when said container is brought into a drying position.

3. The drying station according to claim 1, including an insulating shell surrounding said container together with said at least one heating mat in a drying position, said insulating shell having a wall region and a cover region with a vent opening formed therein.

4. The drying station according to claim 3, including a condenser connected to said vent opening, and a condensate-measuring container connected to said condenser.

5. The drying station according to claim 1, including a transport device for transporting said container, said transport device having a base heater and a pallet-like base for carrying said container, said base having insulation.

6. The drying station according to claim 3, wherein said insulating shell has a ventilation opening formed therein for feeding in a ventilating medium to distribute the heat of evaporation.

7. A drying station for contaminated waste from a nuclear power station, comprising:

a container receiving contaminated waste to be dried from a nuclear power station; and at least one heating mat for delivering heat of evaporation into said container.

* * * * *